US007984631B2

(12) United States Patent
Case et al.

(10) Patent No.: US 7,984,631 B2
(45) **Date of Patent: *Jul. 26, 2011**

(54) MODULAR ESCUTCHEON

(75) Inventors: Christopher N. Case, Indianapolis, IN (US); Robert C. Hunt, Reno, NV (US)

(73) Assignee: Yale Security Inc., Monroe, NC (US)

( * ) Notice: Subject to any disclaimer, the term of this patent is extended or adjusted under 35 U.S.C. 154(b) by 601 days.

This patent is subject to a terminal disclaimer.

(21) Appl. No.: 12/035,907

(22) Filed: Feb. 22, 2008

(65) Prior Publication Data

US 2008/0302149 A1 Dec. 11, 2008

Related U.S. Application Data

(60) Continuation-in-part of application No. 11/164,043, filed on Nov. 8, 2005, now Pat. No. 7,334,442, which is a division of application No. 10/707,566, filed on Dec. 22, 2003, now Pat. No. 7,091,429.

(51) Int. Cl.
*E05B 49/00* (2006.01)

(52) U.S. Cl. ..... 70/278.1; 70/452; D8/308; D8/352

(58) Field of Classification Search ..... 70/278.1, 70/452; D8/308, 352
See application file for complete search history.

(56) References Cited

U.S. PATENT DOCUMENTS

| | | | |
|---|---|---|---|
| 1,492,096 | A | 4/1924 | Bohlman |
| 3,041,720 | A | 7/1962 | Pantas |
| 3,247,332 | A | 4/1966 | McHugh |
| 3,480,728 | A | 11/1969 | Chandler |
| 3,491,221 | A | 1/1970 | Zamarra |
| 4,426,862 | A | 1/1984 | Yamada et al. |
| D279,647 | S | 7/1985 | Ohno |
| D280,073 | S | 8/1985 | Wildgen |
| D280,799 | S | 10/1985 | Ohno |
| 4,632,511 | A | 12/1986 | Louw |
| D297,911 | S | 10/1988 | Rubin |
| 4,841,754 | A | 6/1989 | Jones |
| 4,899,562 | A | 2/1990 | Gartner et al. |
| 4,901,545 | A | 2/1990 | Bacon et al. |

(Continued)

FOREIGN PATENT DOCUMENTS

WO 00/11622 3/2000

(Continued)

OTHER PUBLICATIONS

Stand Alone Access Control, The National Locksmith, Oct. 2003 issue, vol. 74, No. 10, pp. 18, 22, 23, 24, 26, and 28.

(Continued)

*Primary Examiner* — Suzanne D Barrett
(74) *Attorney, Agent, or Firm* — Matthew W. Witsil; Michael G. Johnston; Moore & Van Allen PLLC

(57) ABSTRACT

A modular escutcheon for a door lock including a plurality of covers. Each higher cover may progressively project outward from the surface of a door more than the covers below. Top and bottom edges of adjacent covers abut to form a joint, which may be partly or completely concealed resulting from the outward projections of higher covers. An escutcheon system may be provided that includes interchangeable parts, for example, there may be several different intermediate covers for use with the same lower and upper covers, or different upper covers that may be used in the same position. A variety of lock operating devices may be provided with the different covers to achieve different systems.

27 Claims, 12 Drawing Sheets

U.S. PATENT DOCUMENTS

| | | | |
|---|---|---|---|
| D313,159 | S | 12/1990 | Kautt |
| D313,926 | S | 1/1991 | Kautt |
| 5,060,991 | A | 10/1991 | Davidian et al. |
| 5,136,870 | A | 8/1992 | Gartner et al. |
| 5,301,230 | A | 4/1994 | Barry |
| 5,353,349 | A | 10/1994 | Brown |
| 5,460,020 | A | 10/1995 | Hungerford |
| 5,465,090 | A | 11/1995 | Deignan |
| 5,475,996 | A | 12/1995 | Chen |
| D365,976 | S | 1/1996 | Chiu |
| 5,564,486 | A | 10/1996 | Deigman |
| 5,609,051 | A | 3/1997 | Donaldson |
| 5,640,863 | A | 6/1997 | Frolov |
| 5,651,450 | A | 7/1997 | Priesemuth |
| 5,657,386 | A | 8/1997 | Schwanke |
| 5,709,114 | A | 1/1998 | Dawson et al. |
| 5,748,728 | A | 5/1998 | Ginsberg et al. |
| 5,775,142 | A | 7/1998 | Kim |
| 5,841,347 | A | 11/1998 | Kim |
| 5,873,276 | A | 2/1999 | Dawson et al. |
| 6,286,347 | B1 | 9/2001 | Frolov |
| 6,318,134 | B1 | 11/2001 | Mossberg et al. |
| D452,230 | S | 12/2001 | Taylor et al. |
| D452,231 | S | 12/2001 | Taylor et al. |
| 6,378,344 | B1 | 4/2002 | Gartner |
| D470,033 | S | 2/2003 | Fleury et al. |
| 6,516,641 | B1 | 2/2003 | Segawa |
| D472,794 | S | 4/2003 | LaPlume et al. |
| 6,543,684 | B1 | 4/2003 | White et al. |
| D474,103 | S | 5/2003 | Kaiser et al. |
| 6,668,736 | B1 | 12/2003 | Pallo |
| 7,032,418 | B2 | 4/2006 | Martin et al. |
| 7,091,429 | B2 | 8/2006 | Case et al. |

FOREIGN PATENT DOCUMENTS

| | | |
|---|---|---|
| WO | 00/66859 | 11/2000 |

OTHER PUBLICATIONS

Simplex® Ad, The National Locksmith, Jan. 2004 issue, vol. 75, No. 1, p. 75.

MODULAR ESCUTCHEON

RELATED APPLICATIONS

This application is a continuation-in-part application of U.S. patent application Ser. No. 11/164,043, filed Nov. 8, 2005 and issued as U.S. Pat. No. 7,334,442 on Feb. 26, 2008, which is a divisional application of U.S. patent application Ser. No. 10/707,566, filed Dec. 22, 2003, and issued as U.S. Pat. No. 7,091,429 on Aug. 15, 2006, the entire contents of all of which are incorporated herein by reference.

BACKGROUND

The invention relates to the field of escutcheons for doors, and more particularly modular escutcheons.

Escutcheons function as a trim piece around a latch operator on the surface of a door. Escutcheons may protect and decorate the area around latch and lock operators of a door. Often escutcheons are a single piece that is substantially planar or that may take on a nonplanar shape that extends outward from the door. The shape of escutcheons may be less planar as elements other than a conventional lock operator, which may require additional depth, are provided with the door.

Keypads may be provided, either incorporated into or surrounded by the escutcheon, and are often used to enter private or secure information. For example, such information includes codes for operating door locks, banking account numbers and passwords, and long distance calling card numbers. In order to prevent people positioned behind or adjacent to a user from viewing the keypad, the user must position his or her body or hand over the keypad. In some instances doing so may be difficult or socially awkward, and in general a user may neglect to take such a precaution.

A keypad is disposed on an escutcheon for an electronic door lock for operation of the lock. Upon entry of a predetermined code, the keypad sends an electrical signal to the lock that unlocks the lock. Shields may be used to obstruct the view of the keypad. A conventional shield for a keypad may obstruct the view of the keypad with a front element that covers the keypad and side elements adjacent to the keypad. The front element may be stationary, leaving enough room for a user's hand to operate the keys, or may move, for example, by having a hinge that allows that element to rotate away from the keypad enough to allow a user's hand to operate the keys. The front element may be opaque, which impedes the view by the user, or it may be polarized, preventing view through the element at an angle but allowing direct viewing. However, the front element can interfere with free operation of the keypad. Further, the front element is a part commonly separate from the device that includes the keypad, and is subject to breakage and vandalism.

Side elements are generally mounted vertically adjacent to the sides of the keypad and may also be opaque or polarized. Unfortunately, like the front element, the side elements are parts that are commonly separate from the device that includes the keypad, and accordingly are also subject to damage.

Varied and multiple functionality may be desirable in the lock hardware provided with a door. For example, a keypad may be desired in place of or in addition to a conventional keyed or knob lock operator. Such design may require a completely different escutcheon to be made to accommodate every combination. Significant expense may be incurred to manufacture such custom designs and to store inventory for each type of escutcheon.

Accordingly, there exists a need for an escutcheon that provides for different combinations of operability without requiring a specific version of an escutcheon for every desired selection of elements.

SUMMARY

In accordance with an embodiment of the present invention, a privacy keypad includes a faceplate, a keypad, and at least one protrusion. The keypad is disposed on the faceplate. The protrusion is integral with the faceplate and extends upwardly from the surface of the faceplate laterally adjacent to the keypad. The protrusion obstructs at least partially a line of sight to the keypad by being of a sufficient height and length along the central longitudinal axis of the keypad to do so. The protrusion may be of unitary construction with the faceplate. A line from the center point of the keypad normal to the central longitudinal axis of the keypad to the top of a protrusion may form an angle of at least about 10 degrees with a plane tangential to the surface of the faceplate along the central longitudinal axis of the keypad.

In another embodiment according to the present invention, a privacy keypad includes two parallel protrusions laterally adjacent to and on opposite sides of the keypad. Each protrusion at least partially obstructs a line of sight to the keypad. The protrusions may define a longitudinal channel in the faceplate for receiving the keypad.

In another embodiment according to the present invention, a privacy keypad includes a faceplate, a keypad disposed on the faceplate, and two parallel protrusions. The two parallel protrusions extend upwardly from the surface of the faceplate laterally adjacent to and on opposite sides of the keypad to define a longitudinal channel in the faceplate for receiving the keypad. The protrusions are integral and of unitary construction with the faceplate, and each protrusion is of a sufficient height and length along the longitudinal axis of the keypad to obstruct at least partially a line of sight to the keypad.

In another embodiment according to present invention, an escutcheon for a door lock includes a housing, a keypad, and at least one protrusion. The keypad is disposed on the housing for unlocking the door lock. The protrusion is integral with the housing and extends upwardly from the surface of the housing laterally adjacent to the keypad. The protrusion obstructs at least partially a line of sight to the keypad by being of a sufficient height and length along the central longitudinal axis of the keypad to do so. The protrusion may be of unitary construction with the housing. A line from the center point of the keypad normal to the central longitudinal axis of the keypad to the top of a protrusion may form an angle of at least about 10 degrees with a plane tangential to the surface of the housing along the central longitudinal axis of the keypad.

In another embodiment according to the present invention, an escutcheon for a door lock includes two parallel protrusions laterally adjacent to and on opposite sides of the keypad. Each protrusion at least partially obstructs a line of sight to the keypad. The protrusions may define a longitudinal channel in the housing for receiving the keypad.

In another embodiment according to the present invention, an escutcheon for a door lock includes a housing and a keypad disposed on the housing for unlocking the door lock. Two parallel protrusions extend upwardly from the surface of the housing laterally adjacent to and on opposite sides of the keypad to define a longitudinal channel in the housing for receiving the keypad. The protrusions are integral and of unitary construction with the housing, and each protrusion is of a sufficient height and length along the longitudinal axis of the keypad to obstruct at least partially a line of sight to the keypad.

In another embodiment according to the present invention, a lockset for a door includes a housing, a lock, and a keypad operatively connected to the lock for unlocking the lock by electrical signal. The lock is disposed in and the keypad is disposed on the housing. Two parallel protrusions extend upwardly from the surface of the housing laterally adjacent to and on opposite sides of the keypad to define a longitudinal channel in the housing for receiving the keypad. The protrusions are integral with the housing, and each protrusion is of a sufficient height and length along the longitudinal axis of the keypad to obstruct at least partially a line of sight to the keypad. The protrusions may be of unitary construction with the housing.

In another embodiment according to the present invention, an escutcheon for a door lock includes a lower cover having an opening through which a door latch operator passes. The lower cover has a surface projecting a first distance away from the surface of the door and has a top edge. An upper cover having a bottom edge has a surface that projects away from the surface of the door a second distance that is greater than the first distance. The upper cover is mounted to the surface of the door above the lower cover such that the bottom edge of the upper cover and top edge of the lower cover are in close and complementary registration. The top edge of the lower cover and the bottom edge of the upper cover may be arcuate. The arcuate top edge of the lower cover may be convex while the arcuate bottom edge of the upper cover is concave. The arcuate top edge of the lower cover may be concave while the arcuate bottom edge of the upper cover is convex.

In another embodiment according to the present invention, an escutcheon system for a lock on a door includes a lower cover through which a latch operator passes, adapted to be mounted to the surface of the door and having a top edge. A first upper cover has a bottom edge. The first upper cover is adapted to be mounted to the surface of the door above the lower cover such that the bottom edge of the first upper cover and the top edge of the lower cover are in close and complementary registration. A second upper cover differing from the first upper cover in size, features, or a combination thereof, has a bottom edge. Like the first upper cover, the second upper cover is adapted to be mounted to the surface of the door above the lower cover such that the bottom edge of the second upper cover and top edge of the lower cover are in close and complementary registration. The top edge of the lower cover, bottom edge of the first top cover, and bottom edge of the second lower cover may be arcuate.

In another embodiment according to the present invention, an escutcheon system for a lock on a door includes an upper cover adapted to be mounted to the surface of the door and having a bottom edge. A first lower cover through which a latch operator passes has a top edge. The first lower cover is adapted to be mounted to the surface of the door below the upper cover such that the top edge of the first lower cover and bottom edge of the upper cover are in close and complementary registration. A second lower cover through which a latch operator passes differs from the first upper cover in size, features, or a combination thereof. The second lower cover has a top edge. Like the first lower cover, the second lower cover is adapted to be mounted to the surface of the door below the upper cover such that the top edge of the second lower cover and bottom edge of the upper cover are in close and complementary registration. The bottom edge of the upper cover, top edge of the first lower cover, and top edge of the second lower cover may be arcuate.

In another embodiment according to the present invention, an escutcheon for a door lock for a door includes a first cover and a second cover. The first cover includes a first facing having a front surface and a back surface, sidewalls that extend from the front and back surfaces and terminate in edges, and first and second ends. The first cover facing is spaced a maximum, first distance away from the first cover sidewall edges. The second cover includes a second facing having a front surface and a back surface, sidewalls that extend from the front and back surfaces and terminate in edges, and first and second ends. The second cover facing is spaced a maximum, second distance away from the second cover sidewall edges. The second distance is greater than the first distance such that when the first cover sidewall edges and second cover sidewall edges are coplanar, the second cover facing extends beyond the first cover facing. The first cover second end and the second cover first end are adapted to abut in close and complementary registration to form a joint. One of the covers is adapted to pass a latch operator. Additional covers may similarly be added to the second and subsequent covers.

In another embodiment according to the present invention, an escutcheon for a door lock for a door includes a lower cover adapted to be mounted to the door, having a surface spaced a maximum, first distance away from the surface of the door and having a top edge. An intermediate cover is adapted to be mounted to the door and has a bottom edge, a top edge, and a surface spaced from the surface of the door a maximum, second distance, the second distance being greater than the first distance. The intermediate cover is adapted to be mounted to the surface of the door above the lower cover such that the bottom edge of the intermediate cover and top edge of the lower cover are in close and complementary registration to form a joint. An upper cover is adapted to be mounted to the door, has a bottom edge, and has a surface spaced from the surface of the door a maximum, third distance, the third distance being greater than the second distance. The upper cover is adapted to be mounted to the surface of the door above the intermediate cover such that the bottom edge of the upper cover and top edge of the intermediate cover are in close and complementary registration to form a joint. One of the covers is adapted to pass a latch operator.

In another embodiment according to the present invention, an escutcheon for a door lock for a door includes a lower cover adapted to be mounted to the door, having a top edge and a surface spaced a maximum, first distance away from the surface of the door. A first intermediate cover is adapted to be mounted to the door and has a bottom edge, a top edge, and a surface spaced from the surface of the door a maximum, second distance, the second distance being greater than the first distance. The first intermediate cover is adapted to be mounted to the surface of the door above the lower cover such that the bottom edge of the first intermediate cover and top edge of the lower cover are in close and complementary registration to form a joint. A second intermediate cover is adapted to be mounted to the door, having a bottom edge, a top edge, and a surface spaced from the surface of the door a maximum, third distance, the third distance being greater than the second distance. The second intermediate cover is adapted to be mounted to the surface of the door above the first intermediate cover such that the bottom edge of the first intermediate cover and top edge of the lower cover are in close and complementary registration to form a joint. An upper cover is adapted to be mounted to the door, has a bottom edge, and has a surface spaced from the surface of the door a maximum, fourth distance, the fourth distance being greater than the third distance. The upper cover is adapted to be mounted to the surface of the door above the second intermediate cover such that the bottom edge of the upper cover and top edge of the second intermediate cover are in close and complementary registration to form a joint. One of the covers is adapted to pass a latch operator.

In another embodiment according to the present invention, an escutcheon for a door lock for a door includes a lowest cover adapted to be mounted to the door, having a surface spaced a maximum, first distance away from the surface of the door and having a top edge. A highest cover is adapted to be mounted to the door, has a bottom edge, and has a surface spaced from the surface of the door a maximum, second distance, the second distance being greater than the first distance. A plurality of intermediate covers is adapted to be mounted to the door including a lower intermediate cover, an upper intermediate cover, and optionally other intermediate covers, each having a top edge, a bottom edge, and a surface adapted to be spaced from the surface of the door a maximum distance that is between the first distance and the second distance, with such distance increasing with each intermediate cover as progressing from the lower cover to the upper cover. The bottom edge of the lower intermediate cover and top edge of the lowest cover are in close and complementary registration to form a joint. The top edge of the upper intermediate cover and bottom edge of the highest cover are in close and complementary registration to form a joint. One of the covers is adapted to pass a latch operator.

In another embodiment according to the present invention, an escutcheon system for a door lock for a door includes a lower cover adapted to be mounted to the surface of the door and having a top edge. A first intermediate cover is provided having a top edge and a bottom edge, with the first intermediate cover adapted to be mounted to the surface of the door above the lower cover such that the bottom edge of the first intermediate cover and the top edge of the lower cover are in close and complementary registration. Optionally, a second intermediate cover having a top edge and a bottom edge is provided, with the second intermediate cover adapted to be mounted to the surface of the door above the first intermediate cover such that the bottom edge of the second intermediate cover and the top edge of the first intermediate cover are in close and complementary registration. There are first and second upper covers. The first upper cover has a bottom edge and is adapted to be mounted to the surface of the door above any selected one of the intermediate covers, designated to be a top intermediate cover, such that the bottom edge of the first upper cover and the top edge of the top intermediate cover are in close and complementary registration. The second upper cover differs from the first upper cover in size, features, or a combination thereof, and has a bottom edge, with the second upper cover adapted to be mounted to the surface of the door above the top intermediate cover such that the bottom edge of the second upper cover and top edge of the top intermediate cover are in close and complementary registration. One cover is adapted to pass a latch operator. Additional intermediate covers may be provided that may substitute for the first and optional second intermediate covers.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DESCRIPTION

Figure 1:
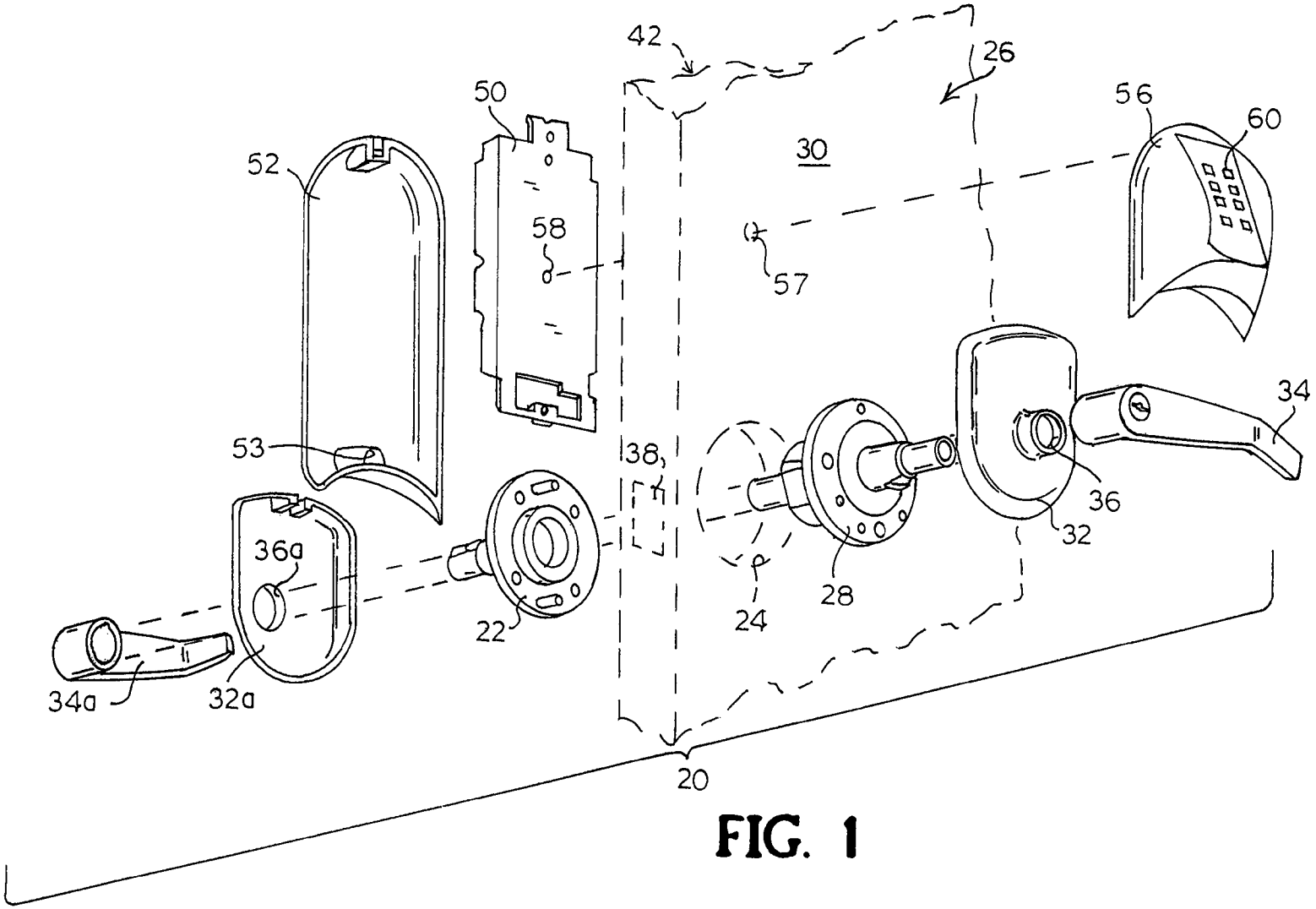
FIG. 1 is an exploded perspective view of an embodiment of a lockset according to the present invention.

In the Figures herein, unique features receive unique reference numerals, while features that are the same in more than one drawing receive the same reference numerals throughout. Where a feature is modified between figures or is modified only by a change in location, a letter may be added or changed after the feature reference numeral to distinguish that feature from a similar feature in a previous figure or the same feature in an alternate location. Further, certain terms of orientation may be used, such as "upper," "lower," "top," "bottom," "left," "right," "inside," "outside," "inner," and "outer." These terms are generally for convenience of reference, and should be so understood unless a particular embodiment requires otherwise.

The scope of the invention is not intended to be limited by materials listed herein, but may be carried out using any materials that allow the construction and operation of the present invention. Materials and dimensions depend on the particular application. In general the materials of the components may be metal, and selectively may be plastic, as known by one of ordinary skill in the art.

Referring now to the drawings, an embodiment of a lockset 20 according to the present invention is shown in FIG. 1. The lockset 20 includes an inner rose assembly 22 mounted through an opening 24 in a door 26 to an outer rose assembly 28 as is conventional. Fasteners and electrical wiring are omitted from FIG. 1 for clarity.

Figure 4:
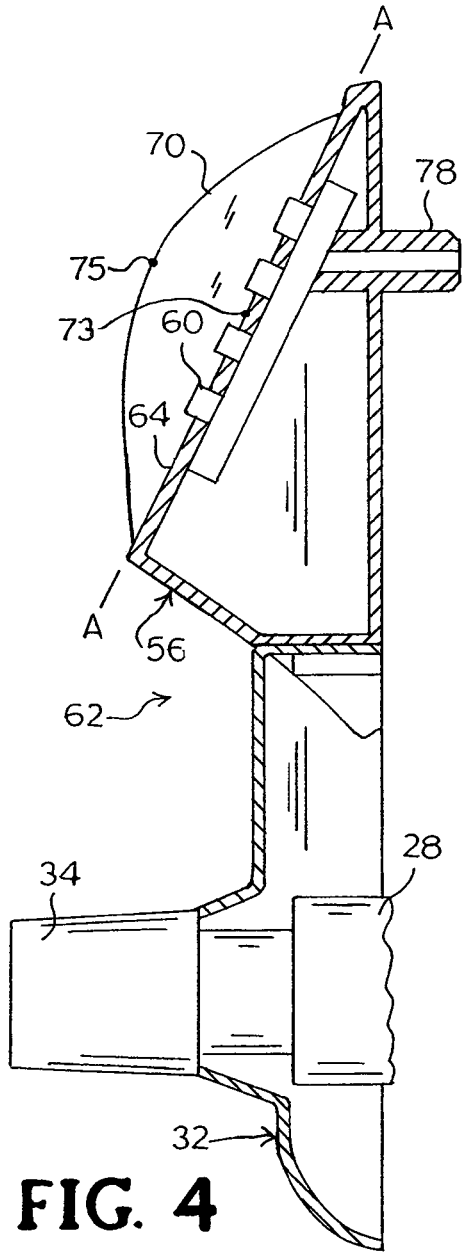
FIG. 4 is a section view of the escutcheon and door handle taken along the line 4-4 of FIG. 2.

A lower cover 32 fits over the outer rose assembly 28 and against the outside surface 30 of the door 26. An opening 36 in the lower cover 32 allows connection of an outside lever handle 34 to an operating spindle associated with the outer rose assembly 28. As best seen in FIG. 4, the diameter of the hub of the outside lever handle 34 is slightly larger than the opening 36 in the lower cover 32 so that the lower cover 32 is held snugly against the outside surface 30 of the door 26. Referring again to FIG. 1, a lower cover 32*a* is similarly mounted against the inside surface 42 of the door 26. Specifically, a hub of an inside lever handle 34*a* having a diameter slightly larger than an opening 36*a* in the lower cover 32*a* is fixed for rotation with an operating spindle associated with the inner rose assembly 22. It is understood that rotation of either handle 34, 34*a* functions to retract a latch (not shown) which extends through an opening 38 in the edge of the door 26.

A battery holder 50 is fastened to the inside surface 42 of the door 26 above the lower cover 32*a* for accommodating batteries (not shown) which provide an electrical power source for operating the lockset 20. An upper cover 52 is fastened to the battery holder 50 and against the inside surface 42 of the door 26 with a fastener (not shown) through an opening 53 in the upper cover 52. Similarly, an upper cover 56 is mounted against the outside surface 30 of the door 26 above the lower cover 32. The upper cover 56 includes a transverse threaded socket 78 (FIGS. 3 and 4) that is received in an opening 57 in the door 26. A fastener (not shown) extends through an opening 58 in the battery holder 50 for securing the outer upper cover 56 to the door 26. The upper and lower covers 52, 32*a*, 56, 32 on each side of the door 26 form inner and outer escutcheon housings, respectively. A keypad 60 is provided on the outer upper cover 56.

Figure 2:
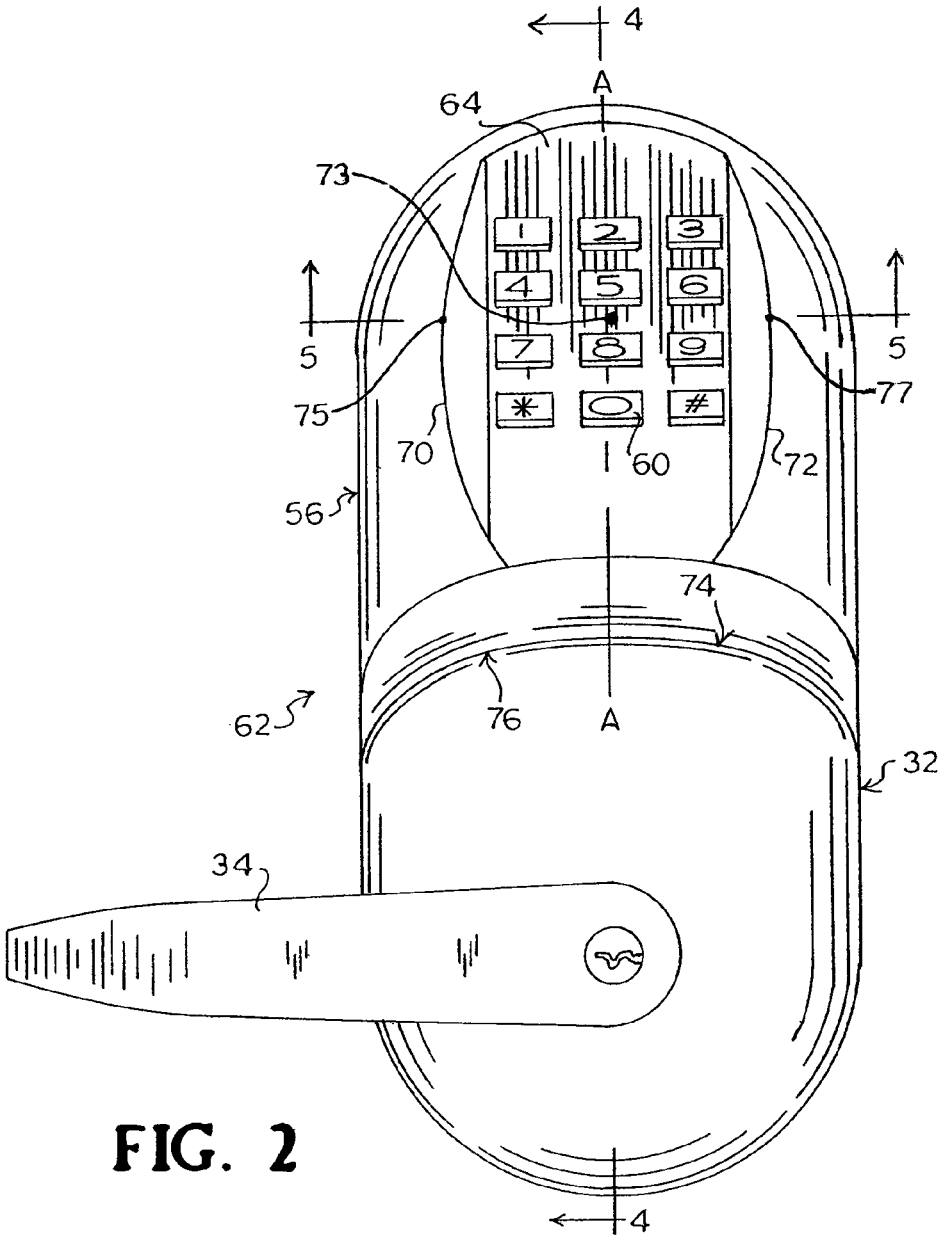
FIG. 2 is a front elevation view of an outer escutcheon and door handle of the lockset of FIG. 1.

The outer escutcheon 62 is shown in FIG. 2. The bottom edge 74 of the upper cover 56 is concave and mates with the top edge 76 of the lower cover 32, which is convex. A channel 64 having a central longitudinal axis A-A is formed in the surface of the upper cover 56 and is defined by upstanding sidewalls 70, 72. In this embodiment of the present invention, the sidewalls 70, 72 are of unitary construction with the upper cover 56, in that the sidewalls 70, 72 and upper cover 56 are all formed from one piece of material. This integral and unitary construction reduces or eliminates the opportunity for damage to the sidewalls 70, 72.

The keypad 60 is mounted in the channel 64. In this embodiment the central longitudinal axis A-A of the channel 64 is also the central longitudinal axis of the keypad 60. The keypad 60 may comprise a touch sensitive device or buttons, as shown, that extend outwardly from the surface of the channel 64. The channel 64 that is shown has a substantially planar surface, but other shapes such as a curved surface or the like may be used.

Figure 5:
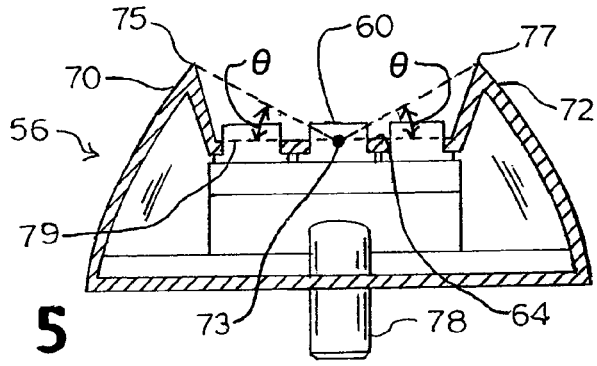
FIG. 5 is a section view of the escutcheon and door handle taken along the line 5-5 of FIG. 2.
Figure 3:
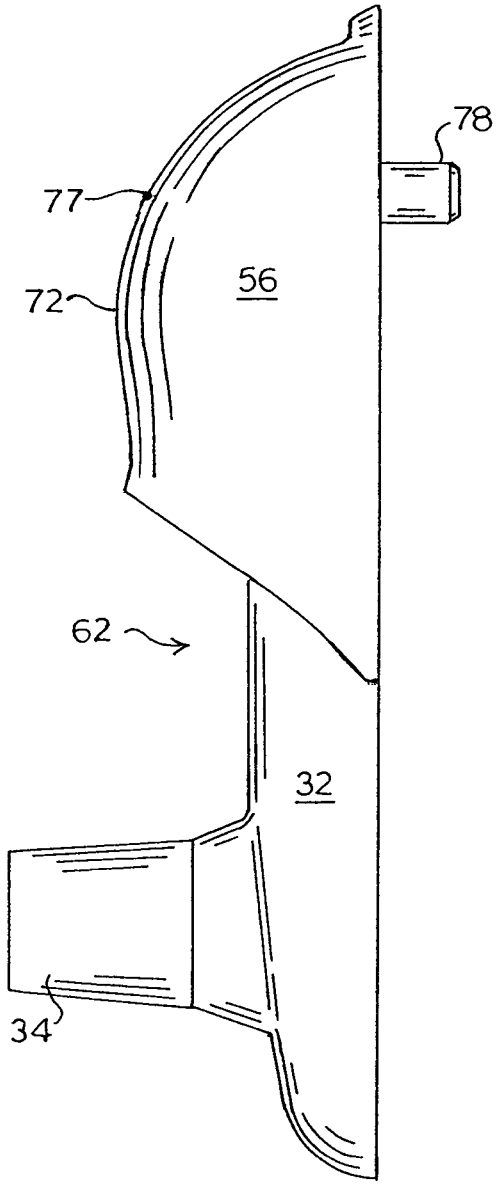
FIG. 3 is a side elevation view of the outer escutcheon and door handle of FIG. 2.

As best seen in FIG. 3, when the outer escutcheon 62 is viewed from a position adjacent to the door 26, the keypad 60 is obstructed by the sidewalls 70, 72 that shield the keypad 60. FIGS. 4 and 5 are section views of the outer escutcheon 62 showing that the sidewalls 70, 72 protrude from the surface of the channel 64 and beyond the keys to shield the keypad 60 from the view of an observer.

To shield the keypad from the view of an observer the sidewalls 70, 72 must be a certain height. The height of a sidewall 70, 72 may be determined by considering that the sidewalls 70, 72 protrude to a height from the surface of the channel 64 that corresponds to a predetermined angle from the center of the keypad 60, in conjunction with the lateral spacing of the sidewalls 70, 72 from the keypad 60. Referring to FIGS. 2, 4, and 5, this necessary height is best shown by a line from the center point 73 of the keypad 60 normal to the central longitudinal axis A-A to the top 75, 77 of the sidewall 70, 72 that forms an angle θ of at least about 10 degrees with a plane 79 tangential to the surface of the channel 64 along the central longitudinal axis A-A. In the embodiment shown, the tops 75, 77 of the sidewalls 70, 72 are closely adjacent to the keypad 60 and are sufficiently close to obstruct at least partially the view of the keypad 60 by an observer. The sidewalls 70, 72 may taper longitudinally as shown, but need not do so and must remain a height that continues to obstruct at least partially the view of the keypad 60 by an observer.

Figure 6:
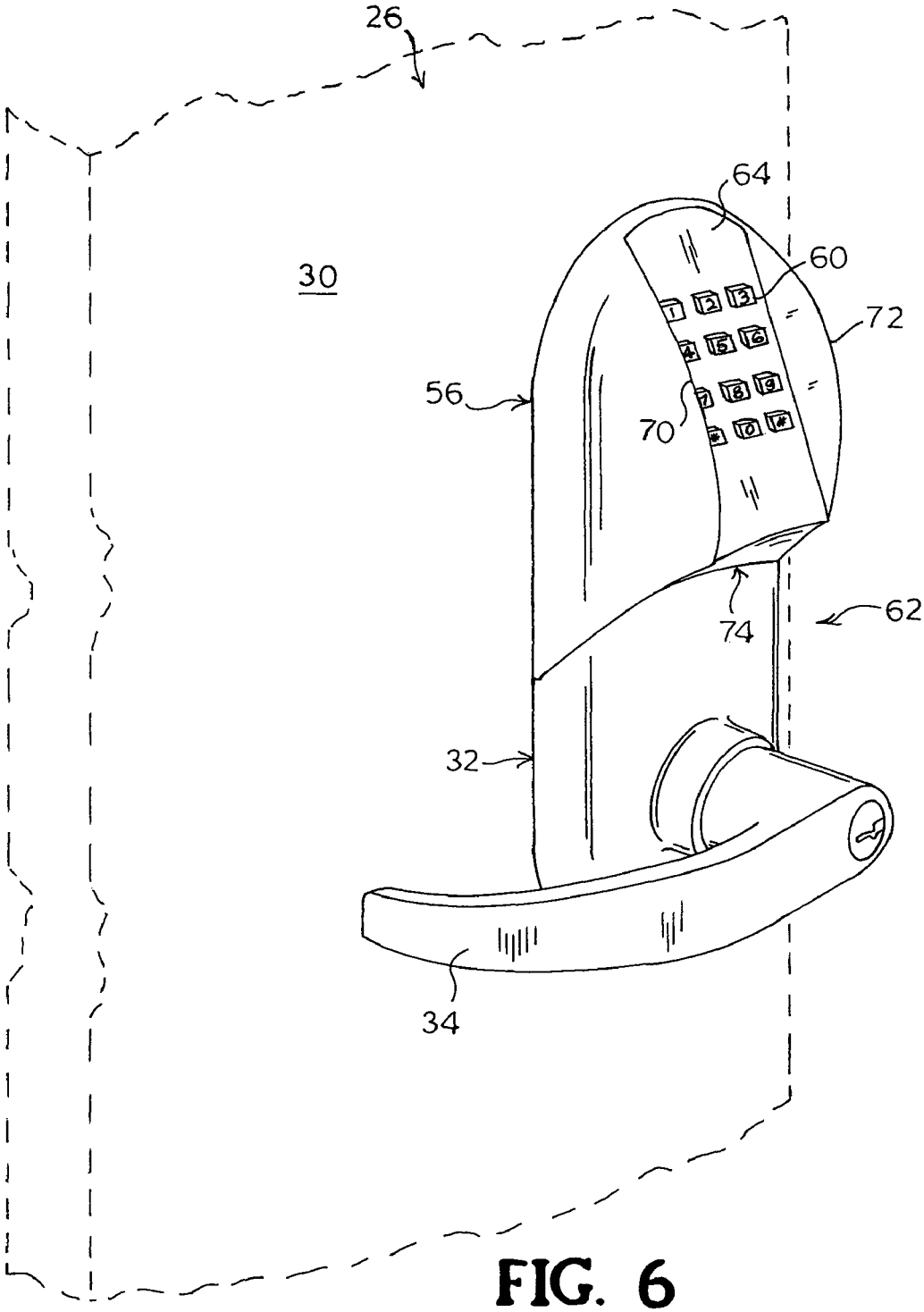
FIG. 6 is a perspective view of the escutcheon and door handle of FIG. 2.

FIG. 6 is a perspective view of the outer escutcheon 62 as viewed by a typical observer. This figure shows that as the outer escutcheon 62 is viewed from this angle, the line of sight to the keypad 60 is obstructed. The keypad 60 becomes less visible as the observer moves closer to the door 26. Also, from the vantage point shown in FIG. 6, the line of sight to the joint between the upper cover 56 and lower cover 32 is obstructed. Even where the joint may be in view, the joint can appear to be a bend in the escutcheon 62 rather than a joint between two parts.

Figure 7:
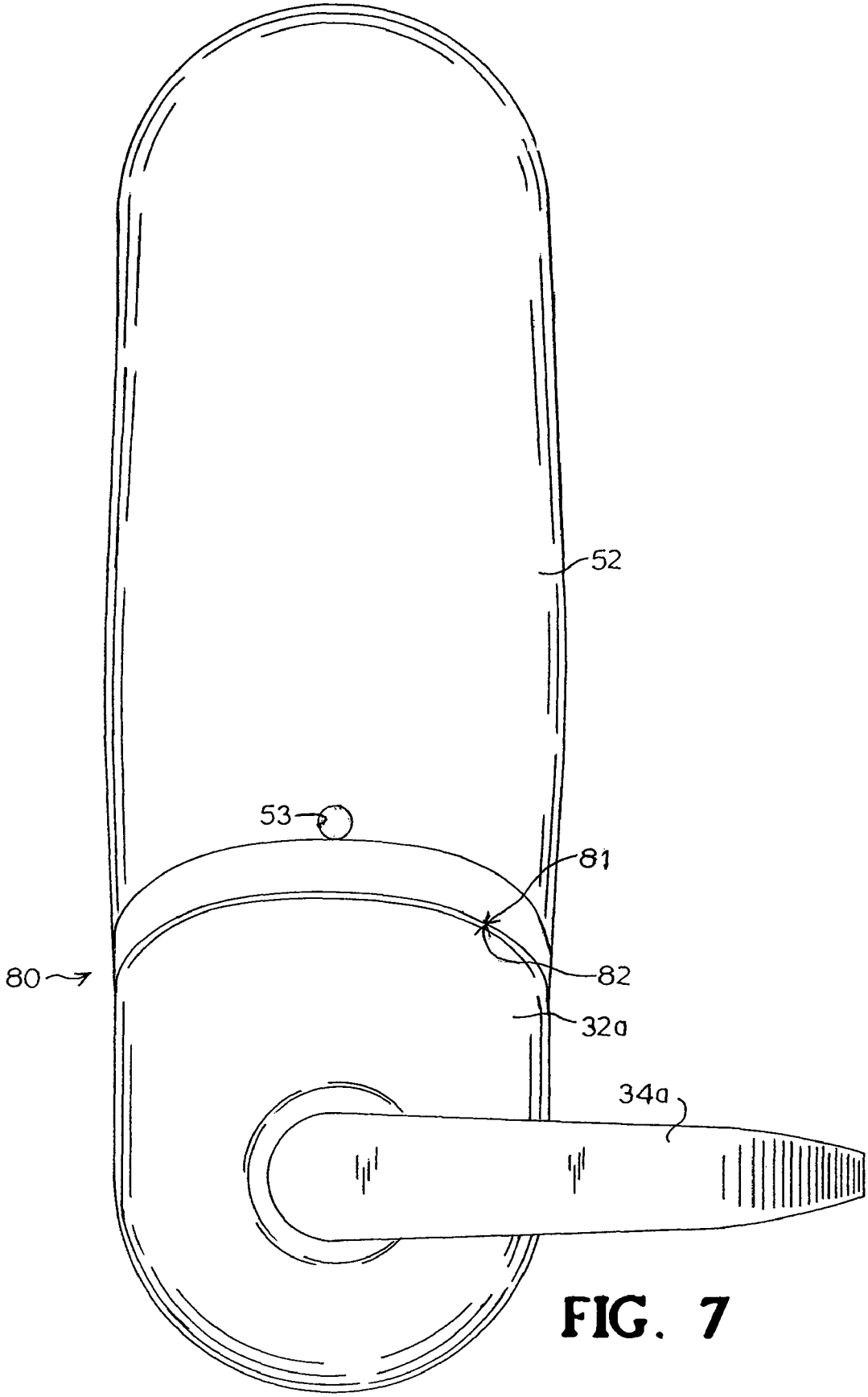
FIG. 7 is a front elevation view of an inner escutcheon and door handle of the lockset of FIG. 1.

The inside escutcheon 80, comprising an upper cover 52 that covers the battery holder 50 and the lower cover 32*a*, is shown in FIG. 7. The bottom edge 81 of the upper cover 52 is concave and mates with the upper edge 82 of the lower cover 32*a*, which is convex. Conversely, the bottom edge of the upper cover 52 could be convex and the top edge of the lower cover 32*a* could be concave. In addition, the bottom edges of the upper covers 52, 56 and the top edges of the lower covers 32, 32*a* could be straight. A feature of the present invention is the ability to interchange upper covers and lower covers of different shape as long as they have complimentary edges that mate to form a continuous joint. For example, the outer upper cover 56 and inner upper cover 52 are interchangeable because they fit with complementary lower covers.

Figure 8:
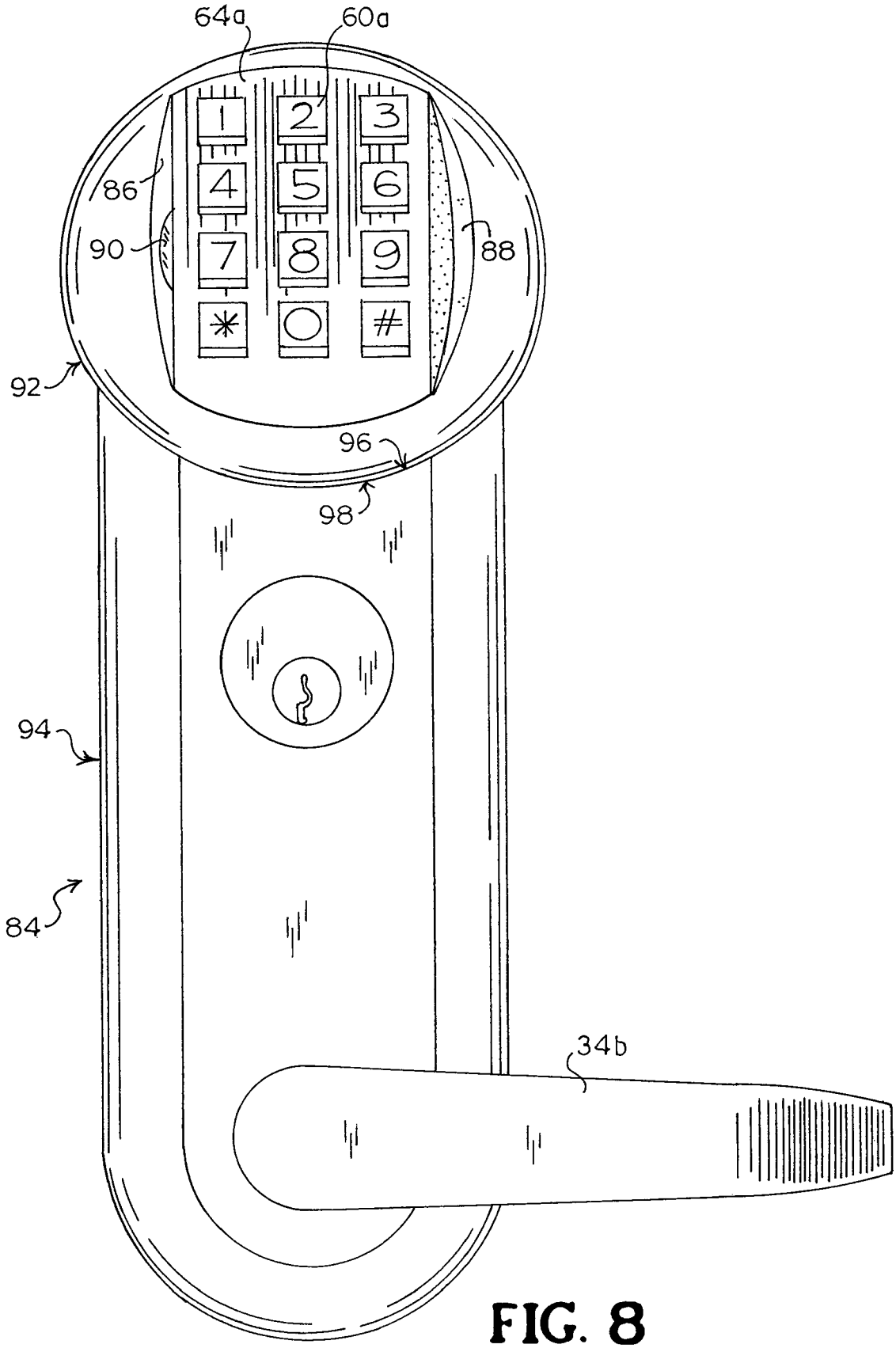
FIG. 8 is a front elevation view of another embodiment of an outer escutcheon and door handle according to the present invention.

Another embodiment of an outer escutcheon is shown in FIG. 8 and generally designated at 84. This embodiment includes an upper cover 92 and a lower cover 94. The upper cover 92 is generally circular in cross-section. The lower cover 94 is elongated relative to that of the prior embodiment of the outer lower cover 32. The bottom edge 96 of the upper cover 92 is convex, and mates with the top edge 98 of the lower cover 94, which is concave. Similarly to the previous embodiments, the upper cover 92 and lower cover 94 may be interchanged with other parts having like joint edges.

Similar to the previously described embodiment of the outer escutcheon 62, a keypad 60*a* is disposed in a longitudinal channel 64*a* defined by upstanding sidewalls 86, 88 on the upper cover 92. The sidewalls 86, 88 are similar to those in the previous embodiment 62 in that the sidewalls 86, 88 are integral with and are a part of the upper cover 92, but differ in that they are not of unitary construction. One sidewall 88 is made of rubber and may be bonded or otherwise attached to the remainder of the upper cover 92. A light source 90, such as a light emitting diode, is provided in one of the sidewalls 86 for illuminating the keypad 60*a*. Optionally light sources may be located on both sidewalls 86, 88.

Figure 9:
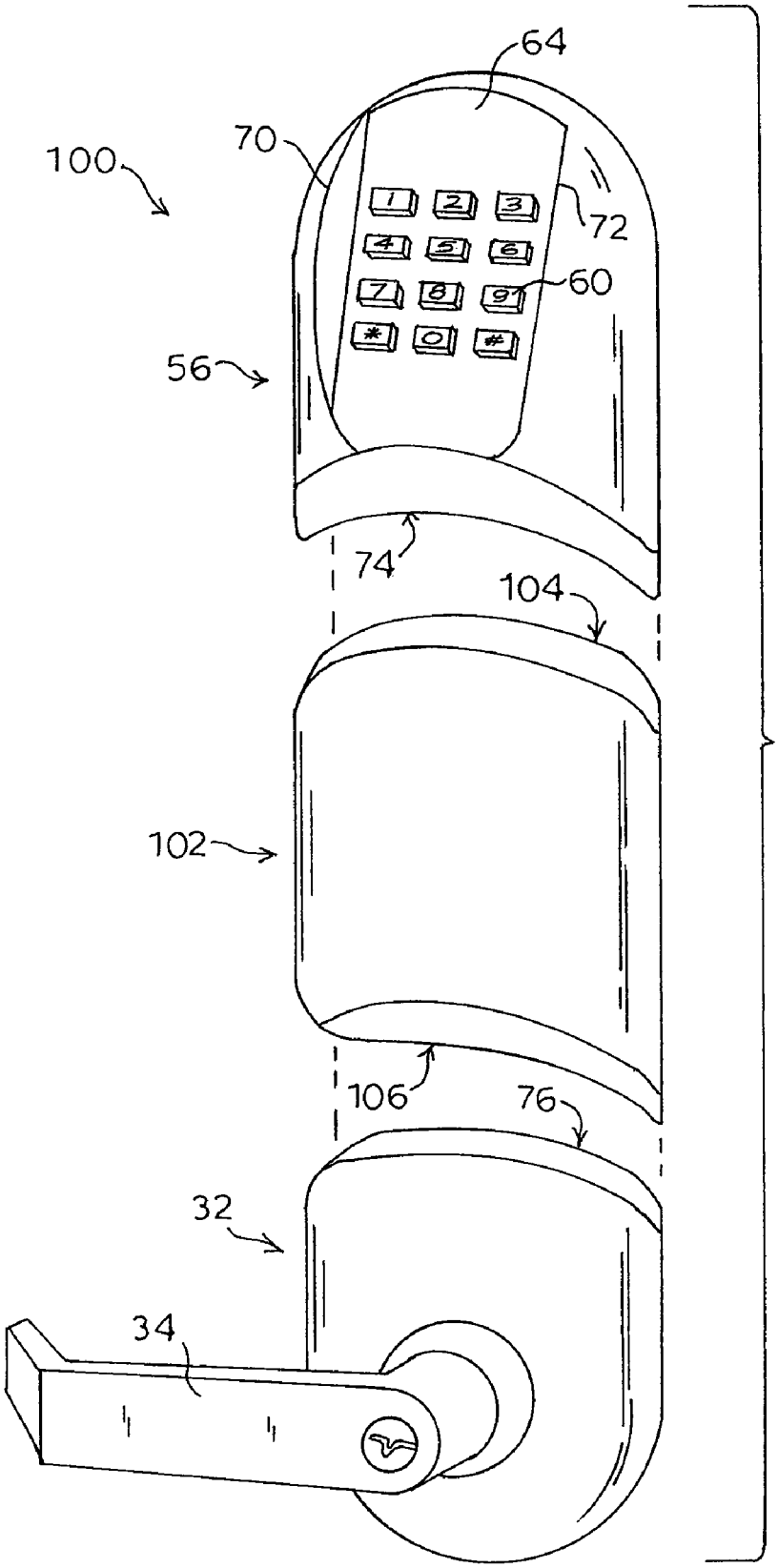
FIG. 9 is an exploded perspective view of another embodiment of an outer escutcheon and door handle according to the present invention.

FIG. 9 shows another embodiment of an escutcheon 100 including three covers, specifically, a lower cover 32, an intermediate cover 102, and an upper cover 56. As with the two piece escutcheon 62 previously discussed, a cover, in this embodiment the lower cover 32, passes a latch operator 34, and the three piece escutcheon 100 may be modular as it may be formed with interchangeable lower, intermediate, and upper covers. The intermediate cover 102 is shown to have a top edge 104 that meets the bottom edge 74 of the upper cover 56, and a bottom edge 106 that meets the top edge 76 of the lower cover 32, to form joints. The edges may be straight or another pattern, such as arcuate as shown, and may be concave or convex. The intermediate cover 102 is a blank in this embodiment 100, serving as a spacer between the lower and upper covers 32, 56.

Figure 10:
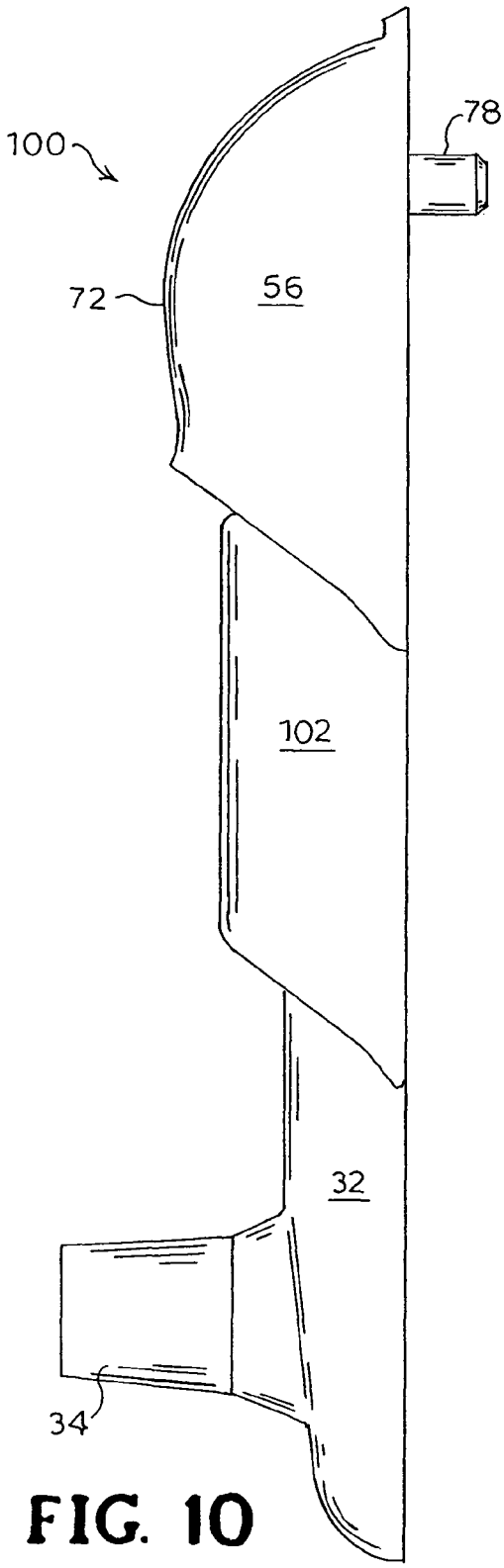
FIG. 10 is a side elevation view of the assembled escutcheon of FIG. 9.

Also similarly to the two piece escutcheon 62, as shown in FIG. 10 the three-piece escutcheon 100 may feature covers 32, 102, 56 that extend laterally from the face of the door an increasing distance with each higher cover. In this three-piece escutcheon, the maximum distance that the surface of a relatively higher cover is spaced from the surface of the door is greater than the maximum distance that the surface of a relatively lower cover is spaced from the surface of the door. A similar relationship between covers may exist when there are additional covers. The intermediate cover 102 extends outward farther than the lower cover 32, and the upper cover 56 extends outward farther than the intermediate cover 102. Such a design may be aesthetically pleasing and may serve to conceal the joints between the edges 104, 74, 106, 76.

Figure 11:
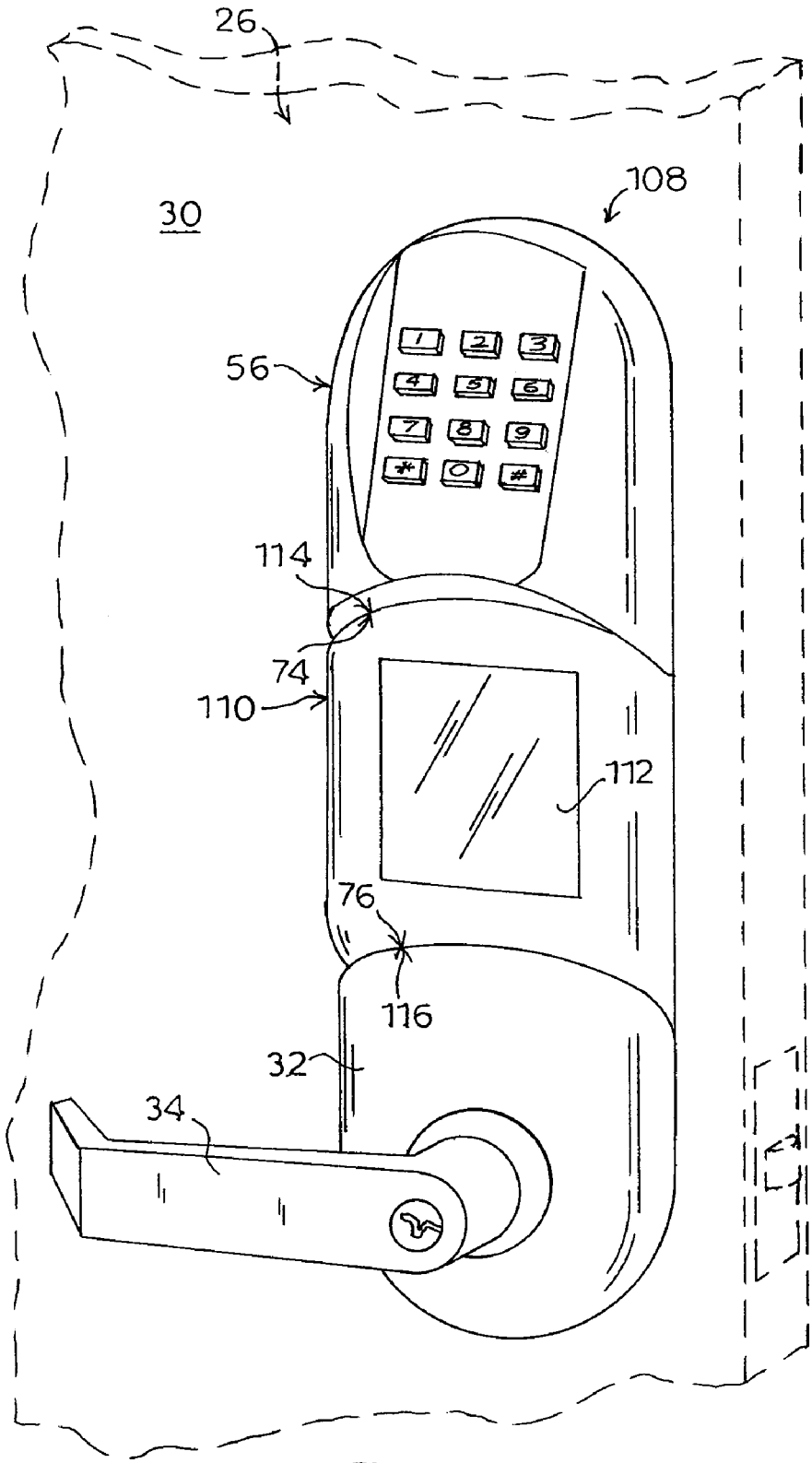
FIG. 11 is a perspective view of another embodiment of an outer escutcheon and door handle according to the present invention.
Figure 12:
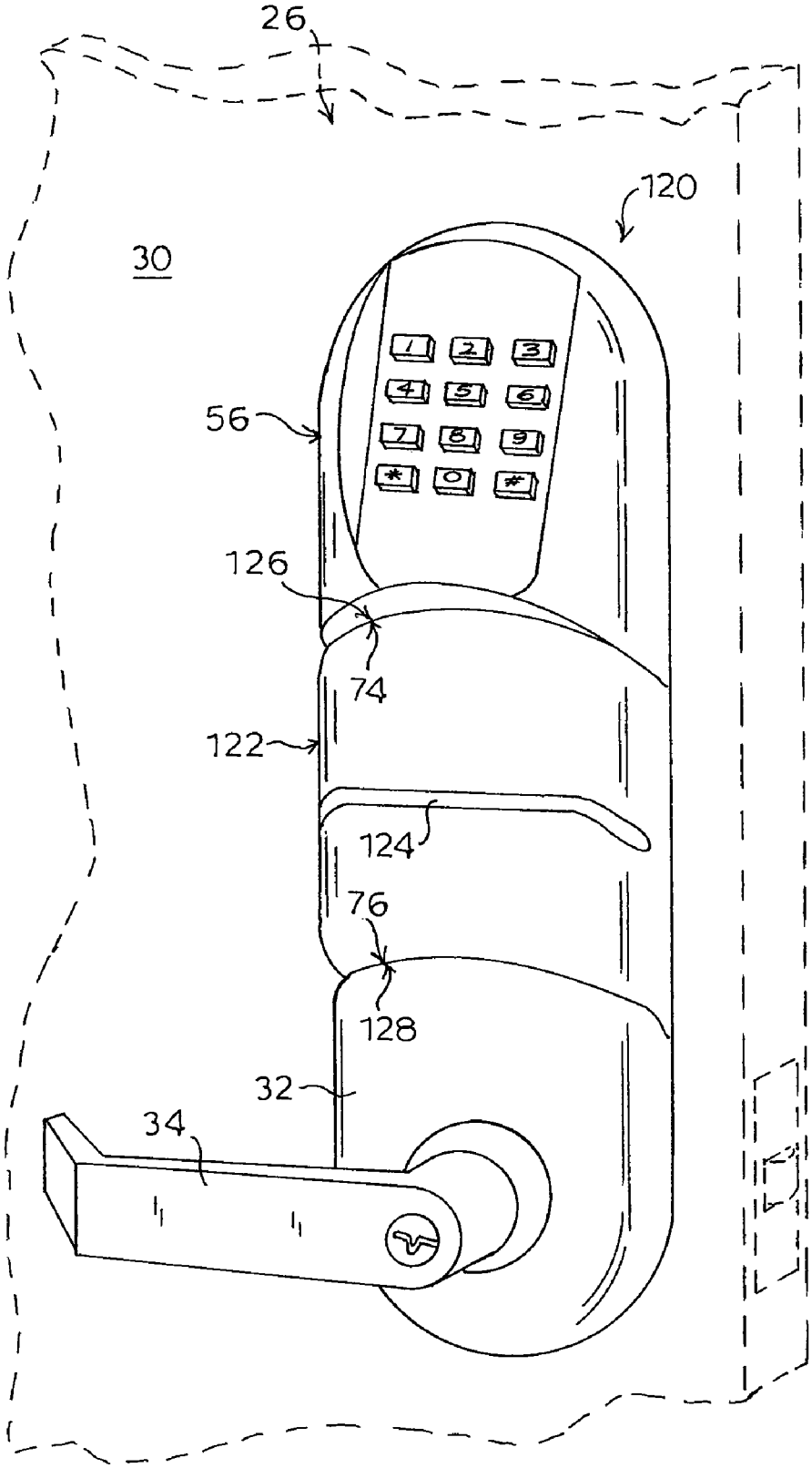
FIG. 12 is a perspective view of another embodiment of an outer escutcheon and door handle according to the present invention.

In FIG. 11, another embodiment of a three-piece escutcheon 108 provides a substitute intermediate cover 110 for the blank intermediate cover 102 of the embodiment of FIG. 9. In this embodiment, the intermediate cover 110 includes a proximity card reader 112. The top edge 114 of the intermediate cover 110 meets the bottom edge 74 of the upper cover 56, and the bottom edge 116 of the intermediate cover 110 meets the top edge 76 of the lower cover 32, to form joints in manner similar to the two-piece escutcheon 62.

As a further example of interchangeability of covers, in FIG. 11 yet another embodiment of a three-cover escutcheon 120 provides a substitute intermediate cover 122 for the blank intermediate cover 102 of the embodiment of FIG. 9. The intermediate cover 122 shown in FIG. 11 includes a card swipe reader 124. The top edge 126 of the intermediate cover 122 meets the bottom edge 74 of the upper cover 56, and the bottom edge 128 of the intermediate cover 122 meets the top edge 76 of the lower cover 32, to form joints.

Figure 13:
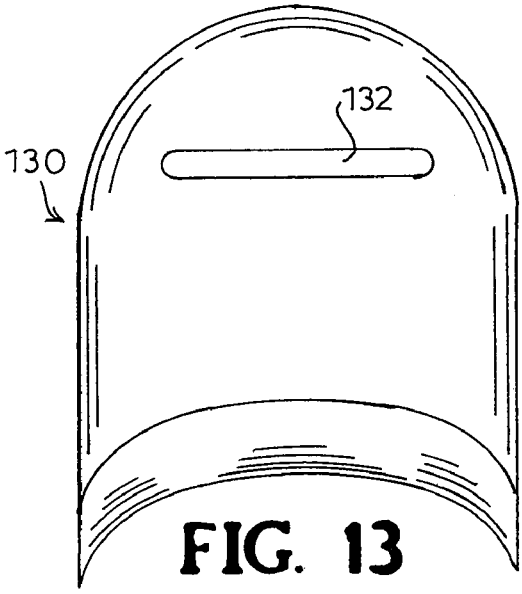
FIGS. 13-15 are alternative covers for use with various embodiments of the present invention.
Figure 14:
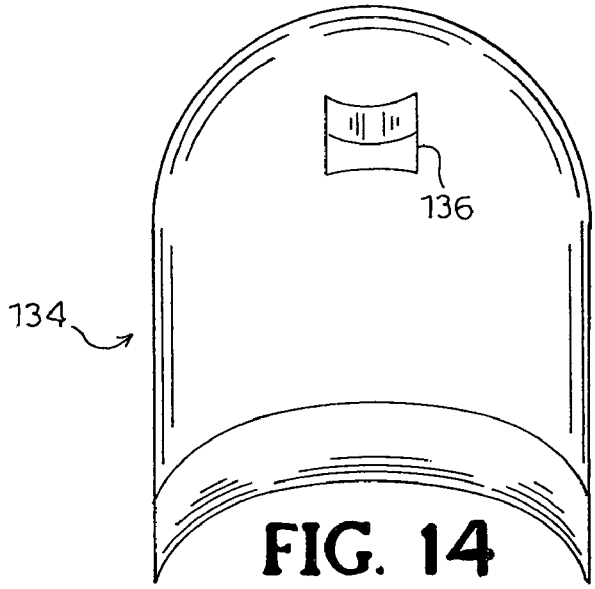
Figure 15:
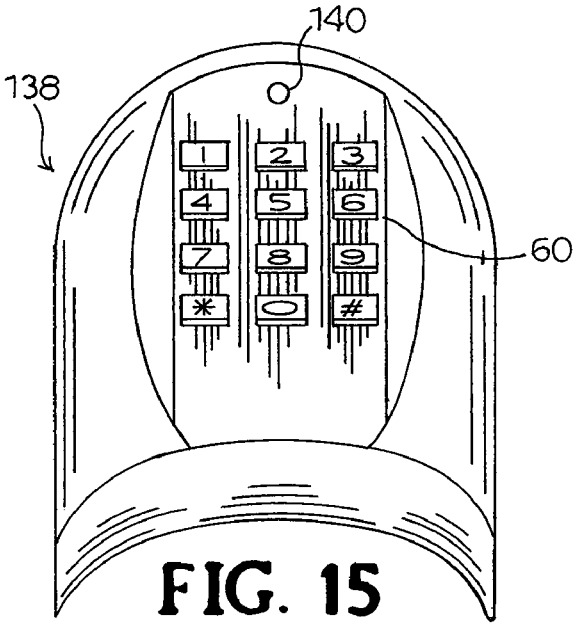

A variety of upper covers may also be provided and substituted for the upper cover 56 of the embodiment of FIG. 9. FIG. 13 shows an upper cover 130 with a card insertion reader 132; FIG. 14 shows an upper cover 134 with a biometric device or fingerprint reader 136; and FIG. 15 shows an upper cover 138 with a keypad 60 and a mini-camera 140. Such features may alternatively be provided on other intermediate covers and some even on lower covers.

Figure 16:
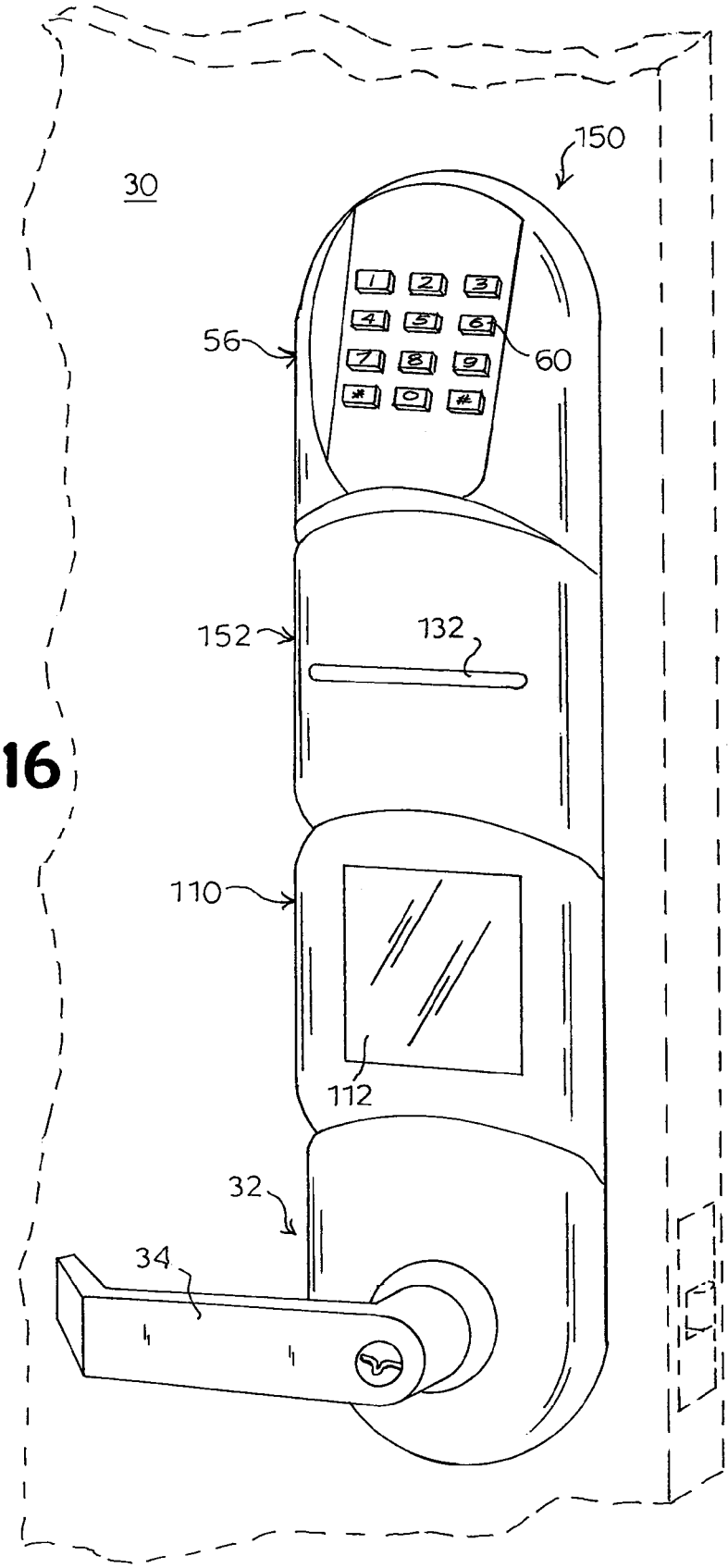
FIG. 16 is a perspective view of another embodiment of an outer escutcheon and door handle according to the present invention.

FIG. 16 shows an embodiment 150 of an escutcheon according to the present invention that has four covers: a lower cover 32, a first intermediate cover 110 with a proximity card reader 112, a second intermediate cover 152 with a card insertion reader 132, and an upper cover 56 with a keypad 60. In this embodiment 150 the bottom edges of the covers 32, 110, 152, 56 are concave up and fit together in close and complementary registration to form joints as with previously discussed embodiments. As shown, the projection of the surface of the covers away from the surface of a door may increase proceeding from lower to higher covers.

The escutcheon of the present invention may include any desired number of covers as practical and features as selected by the designer or purchaser. Regardless of the number of covers, which may include two, three, four, or more covers, the mating edges of covers fit together in close and complementary registration, and in some cases, provide joints that are concealed when the escutcheon is viewed from above, as may be effected by higher covers projecting out from the door more than lower covers.

Specific embodiments of an invention are described herein. One of ordinary skill in the lock and security hardware arts will recognize that the invention has other applications in other environments. In fact, many embodiments and implementations are possible. For example, the escutcheon of the present invention may be made in different shapes and sizes. The mating edges of upper, intermediate, and lower covers may be straight or arcuate, so long as they are in close and complimentary registration. The sidewalls could be applied as shields anywhere keypad security is needed. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. An escutcheon for a lock for a door, the escutcheon comprising:

a first cover including a first facing having a front surface and a back surface, sidewalls extending therefrom terminating in edges, and first and second ends, the first cover facing spaced a maximum, first distance away from the first cover sidewall edges; and a second cover including a second facing having a front surface and a back surface, sidewalls extending therefrom terminating in edges, and first and second ends, the second cover facing spaced a maximum, second distance away from the second cover sidewall edges, the second distance being greater than the first distance such that when the first cover sidewall edges and second cover sidewall edges are coplanar the second cover facing extends beyond the first cover facing, wherein the first cover second end and the second cover first end are adapted to abut in close and complementary registration to form a joint, wherein one cover is adapted to pass a latch operator.

2. The escutcheon of claim 1, further comprising a third cover including a third facing having a front surface and a back surface, sidewalls extending therefrom terminating in edges, and first and second ends, the third cover facing spaced a maximum, third distance away from the third cover sidewall edges, the third distance being greater than the second distance such that when the second cover sidewall edges and third cover sidewall edges are coplanar the third cover facing extends beyond the second cover facing, wherein the second cover second end and the third cover first end are adapted to abut in close and complementary registration to form a joint.

3. The escutcheon of claim 2, optionally further comprising a fourth cover including a fourth facing having a front surface and a back surface, sidewalls extending therefrom terminating in edges, and first and second ends, the fourth cover facing spaced a maximum, fourth distance away from the fourth cover sidewall edges, the fourth distance being greater than the third distance such that when the third cover sidewall edges and fourth cover sidewall edges are coplanar the fourth cover facing extends beyond the third cover facing, wherein the third cover second end and the fourth cover first end are adapted to abut in close and complementary registration to form a joint.

4. The escutcheon of claim 3, wherein one of the covers comprises a keypad for opening the lock.

5. The escutcheon of claim 4, wherein there are two parallel protrusions laterally adjacent to and on opposite sides of the keypad, and wherein each protrusion at least partially obstructs a line of sight to the keypad.

6. The escutcheon of claim 3, wherein one of the covers comprises a proximity card reader.

7. The escutcheon of claim 3, wherein one of the covers comprises a card swipe reader.

8. The escutcheon of claim 3, wherein one of the covers comprises a card insertion reader.

9. The escutcheon of claim 3, wherein one of the covers comprises a biometric device.

10. The escutcheon of claim 3, wherein one of the covers comprises a camera.

11. The escutcheon of claim 3, wherein one of the covers comprises a battery housing.

12. The escutcheon of claim 3, wherein the first end of the optional fourth cover, the first end of the third cover, and the first end of the second cover are arcuate.

13. The escutcheon of claim 12, wherein the first end of the optional fourth cover, the first end of the third cover, and the first end of the second cover are concave.

14. The escutcheon of claim 12, wherein the first end of the optional fourth cover, the first end of the third cover, and the first end of the second cover are convex.

15. The escutcheon of claim 3, wherein when the third cover is oriented above the second cover, the joint formed by the third cover and second cover is obstructed from view when the escutcheon is viewed from above the third cover, and, wherein, when the optional fourth cover is oriented above the third cover, the joint, if present, formed by the optional fourth cover and third cover is obstructed from view when the escutcheon is viewed from above the fourth cover.

16. An escutcheon for a lock for a door, the escutcheon comprising:

a lower cover having a surface and a top edge, the lower cover adapted to be mounted to the door such that the surface is spaced a maximum, first distance away from the surface of the door and having a top edge;

an intermediate cover having a bottom edge, a top edge, and a surface, the intermediate cover adapted to be mounted to the door such that the surface is spaced a maximum, second distance away from the surface of the door, the second distance being greater than the first distance, and the intermediate cover adapted to be mounted to the surface of the door above the lower cover such that the bottom edge of the intermediate cover and top edge of the lower cover are in close and complementary registration to form a joint; and an upper cover having a surface and a bottom edge and adapted to be mounted to the door such that the surface is spaced a maximum, third distance away from the surface of the door, the third distance being greater than the second distance, and the upper cover adapted to be mounted to the surface of the door above the intermediate cover such that the bottom edge of the upper cover and top edge of the intermediate cover are in close and complementary registration to form a joint, and wherein one cover is adapted to pass a latch operator.

17. The escutcheon of claim 16, wherein one of the covers comprises a keypad for opening the lock.

18. The escutcheon of claim 17, wherein there are two parallel protrusions laterally adjacent to and on opposite sides of the keypad, and wherein each protrusion at least partially obstructs a line of sight to the keypad.

19. The escutcheon of claim 16, wherein one of the covers comprises a proximity card reader.

20. The escutcheon of claim 16, wherein one of the covers comprises a card swipe reader.

21. The escutcheon of claim 16, wherein one of the covers comprises a card insertion reader.

22. The escutcheon of claim 16, wherein one of the covers comprises a biometric device.

23. The escutcheon of claim 16, wherein one of the covers comprises a camera.

24. The escutcheon of claim 16, wherein one of the covers comprises a battery housing.

25. The escutcheon of claim 16, wherein the bottom edge of the intermediate cover and the bottom edge of the upper cover are concave.

26. The escutcheon of claim 16, wherein the bottom edge of the intermediate cover and the bottom edge of the upper cover are convex.

27. The escutcheon of claim 16, wherein when the upper cover is oriented above the intermediate cover and the intermediate cover is oriented above the lower cover, the joints are obstructed from view when the escutcheon is viewed from above the upper cover.

* * * * *